US011837036B2

(12) United States Patent
Wendling et al.

(10) Patent No.: US 11,837,036 B2
(45) Date of Patent: Dec. 5, 2023

(54) INTEGRATED ACCESS CONTROL SYSTEM

(71) Applicants: Hugo Wendling, Denver, CO (US); Michael T. Conlin, Superior, CO (US); Daniel William Field, Broomfield, CO (US); Michael William Malone, Boulder, CO (US); Taylor Schmidt, Littleton, CO (US)

(72) Inventors: Hugo Wendling, Denver, CO (US); Michael T. Conlin, Superior, CO (US); Daniel William Field, Broomfield, CO (US); Michael William Malone, Boulder, CO (US); Taylor Schmidt, Littleton, CO (US)

( * ) Notice: Subject to any disclaimer, the term of this patent is extended or adjusted under 35 U.S.C. 154(b) by 343 days.

(21) Appl. No.: 16/924,587

(22) Filed: Jul. 9, 2020

(65) Prior Publication Data

US 2020/0342698 A1 Oct. 29, 2020

Related U.S. Application Data

(62) Division of application No. 16/365,946, filed on Mar. 27, 2019, now Pat. No. 10,916,078.

(51) Int. Cl.
*G07C 9/00* (2020.01)
*G07C 9/30* (2020.01)

(52) U.S. Cl.
CPC ..... *G07C 9/00174* (2013.01); *G07C 9/30* (2020.01); *G07C 2209/62* (2013.01)

(58) Field of Classification Search
CPC ... G07C 9/00174; G07C 9/30; G07C 2209/62
See application file for complete search history.

(56) References Cited

U.S. PATENT DOCUMENTS

| | | | | |
|---|---|---|---|---|
| 8,957,757 | B1 * | 2/2015 | Le Burge | G07C 9/00904 340/5.6 |
| 9,518,408 | B1 * | 12/2016 | Krishnan | E05B 81/80 |
| 10,366,556 | B1 * | 7/2019 | Mondrow | H04W 52/0248 |
| 10,553,054 | B1 * | 2/2020 | Wendling | G07C 9/00182 |
| 2006/0171075 | A1 | 8/2006 | Caveney et al. | |
| 2008/0231432 | A1 * | 9/2008 | Stawar | B62B 3/142 340/8.1 |
| 2013/0127260 | A1 | 5/2013 | Webb et al. | |
| 2013/0342313 | A1 | 12/2013 | Conlin | |
| 2014/0247113 | A1 | 9/2014 | Paquin | |
| 2015/0194002 | A1 * | 7/2015 | Kaczmarz | G07C 9/00174 340/5.2 |

(Continued)

*Primary Examiner* — Nabil H Syed
(74) *Attorney, Agent, or Firm* — Daniel M. Cohn; Howard M. Cohn

(57) ABSTRACT

Disclosed embodiments provide an integrated access control system. The integrated access control system includes both credential reader functionality and door controller functionality in the same package. In embodiments, the circuitry is miniaturized to fit within a standard "single gang" box such as those used for a standard light switch or receptacle. In this way, the integrated access control system of disclosed embodiments installs easily and unobtrusively in standard sized openings. To operate in a confined area such as a single gang box enclosure, a variety of thermal management and power management techniques are employed to provide reliable operation.

17 Claims, 12 Drawing Sheets

(56) References Cited

U.S. PATENT DOCUMENTS

| | | | | |
|---|---|---|---|---|
| 2016/0042582 | A1* | 2/2016 | Hyde | E05B 67/22 70/53 |
| 2017/0092029 | A1 | 3/2017 | Anderson | |
| 2017/0124792 | A1 | 5/2017 | Schoenfelder et al. | |
| 2017/0163944 | A1* | 6/2017 | Jeong | H04N 7/188 |
| 2017/0226784 | A1* | 8/2017 | Davis | E05B 47/00 |
| 2018/0173907 | A1* | 6/2018 | Chis | G06K 7/10198 |
| 2019/0122167 | A1* | 4/2019 | Bashkin | G07C 9/37 |
| 2019/0340856 | A1 | 11/2019 | Gilbert | |
| 2019/0368227 | A1 | 12/2019 | Tabib et al. | |

* cited by examiner

INTEGRATED ACCESS CONTROL SYSTEM

FIELD OF THE INVENTION

The present invention relates generally to access control for building entrances, and more particularly, to an integrated access control system.

BACKGROUND

Electronic access control typically includes various components such as a credential, often in the form of a card or a fob, a credential reader, often mounted near a door, and an electrically activated lock. The electrically activated lock is often a magnetic lock or an electric strike. The system can also include a keypad, exit button, alarm, and/or other accessories.

Many facilities throughout the world utilize electronic access control. Examples of such facilities include hospitals, universities, businesses, factories, military installations, hotels, and residential units. There are thus, many thousands of access control components such as credential readers and access cards in existence today. When a user presents a credential to the reader and the credential is read, the credential reader sends the credential data to an access controller mounted somewhere on the premises behind the secure side of the door. The access controller then compares the data received from the electronic credential reader with a database of valid access credentials. If the credential is determined to have valid access privileges the controller energizes a relay that momentarily enables the unlocking mechanism of the door.

SUMMARY

In one embodiment, there is provided an integrated access system, comprising: a processor; a memory coupled to the processor; a tamper detection circuit; a temperature detection circuit; a power monitoring circuit; one or more light emitting diodes; a communication interface; and a lock interface configured and disposed to operate an electronically activated lock.

In another embodiment, there is provided an integrated access system, comprising: a processor; a memory coupled to the processor; one or more credential transceivers; a tamper detection circuit; a temperature detection circuit; a power monitoring circuit; one or more light emitting diodes; a communication interface; a lock interface configured and disposed to operate an electronically activated lock; wherein the memory contains instructions, that when executed by the processor, perform the steps of: detecting an overtemperature condition from the temperature detection circuit; sending an overtemperature alert message to a remote computing device; and disabling the one or more light emitting diodes in response to the overtemperature condition.

In yet another embodiment, there is provided an integrated access system, comprising: a processor; a memory coupled to the processor; one or more credential transceivers; a tamper detection circuit; a temperature detection circuit; a power monitoring circuit; one or more light emitting diodes; a communication interface; a lock interface configured and disposed to operate an electronically activated lock; wherein the memory contains instructions, that when executed by the processor, perform the steps of: detecting a tamper condition from the tamper detection circuit; and sending a tamper alert message to a remote computing device.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity. Furthermore, for clarity, some reference numbers may be omitted in certain drawings.

DETAILED DESCRIPTION

Disclosed embodiments provide an integrated access control system. The integrated access control system includes both credential reader functionality and door controller functionality in the same package. In embodiments, the circuitry is miniaturized to fit within a standard "single gang" box such as those used for a standard light switch or receptacle. In this way, the integrated access control system of disclosed embodiments installs easily and unobtrusively in standard sized openings. To operate in a confined area such as a single gang box enclosure (12-cubic inch), a variety of thermal management and power management techniques are employed to provide reliable operation.

Figure 1A:
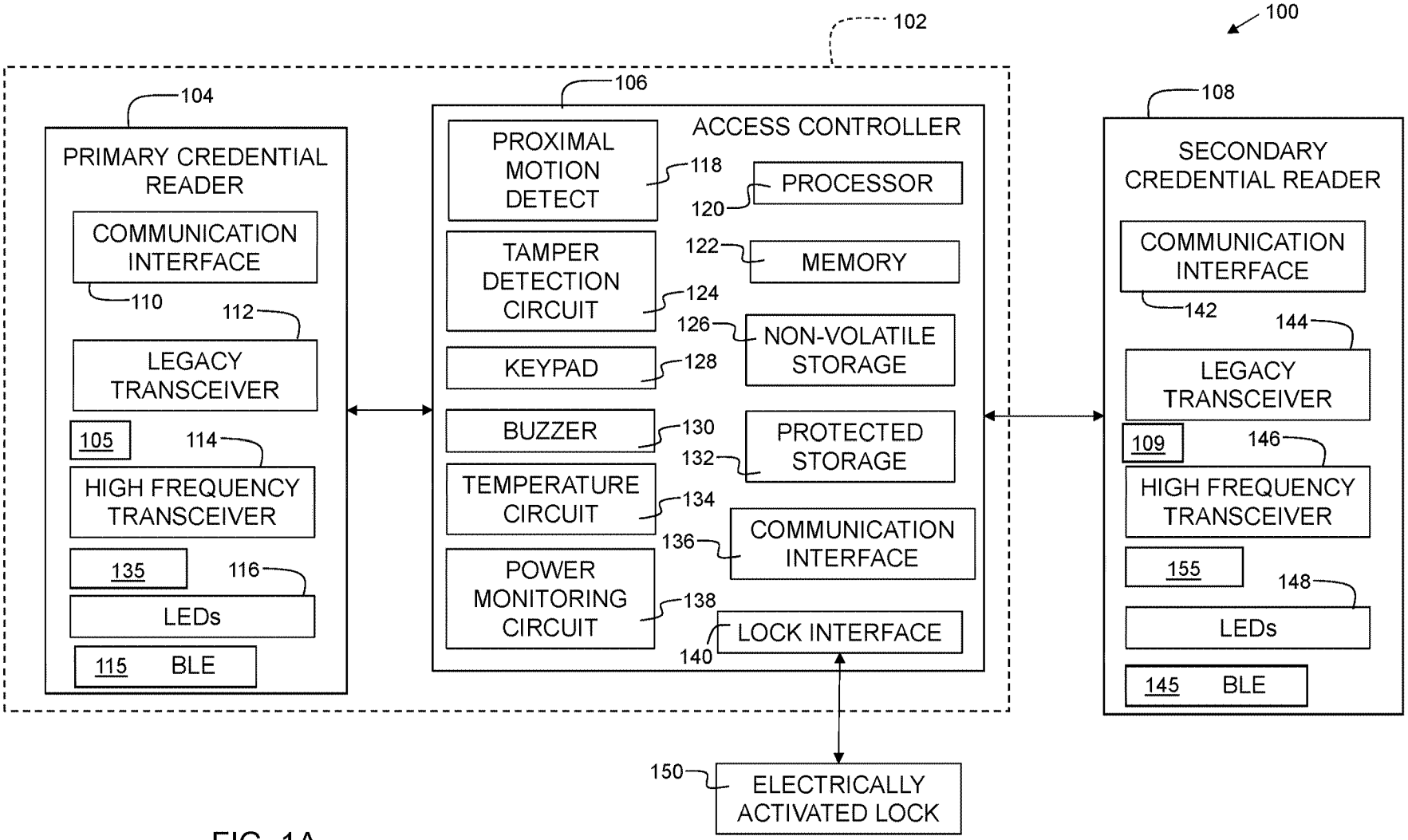
FIG. 1A shows a block diagram of an embodiment of the present invention.

FIG. 1A shows a block diagram 100 of an embodiment of the present invention. The integrated access control system 102 includes a primary credential reader 104 and an access controller 106. The primary credential reader 104 includes a communication interface 110. The communication interface 110 may include an RS-485 interface, as well as a wireless communication interface such as Bluetooth, Zigbee, or other suitable protocol. The primary credential reader 104 may include a legacy transceiver 112. The legacy transceiver 112 may be used to support legacy credentials operating at 125 kHz. The primary credential reader 104 includes a high frequency transceiver 114. The high frequency transceiver 114 may operate at 13.56 MHz or 2.4 GHz, or other suitable range. In some embodiments, the high frequency transceiver may operate at a frequency range between 300 MHz and 3 GHz. Embodiments may include a Bluetooth Low Energy (BLE) transceiver 115 operating at the 2.4 GHz range. One or more light emitting diodes (LEDs) 116 may be present on the primary credential reader 104. The LEDs 116 may indicate a variety of conditions, including, but not limited to, a power-on state, a credential detect state, an unlocked state, a locked state, and/or a variety of other conditions. A tamper detection circuit 135 may also be installed on a circuit board within the credential reader 104. In embodiments, the tamper detection circuit comprises an accelerometer. In embodiments, the accelerometer may be a 3-axis accelerometer that is capable of detecting motion in any direction. In the event that a malicious actor attempts to remove or damage the integrated access system 102, that activity will cause motion that is detected by the tamper detection circuit 135. In some embodiments, the credential reader 104 may include a microcontroller 105, which contains a processing element, memory, storage, input/output, and/or other peripherals to operate elements of the credential reader, including the LEDs 116 and tamper detection circuit 135.

In some embodiments, the microcontroller 105 within the credential reader 104 contains instructions, that when executed by the microcontroller 105, send a message to the access controller 106 in response to detecting a tamper signal from tamper detection circuit 135. In embodiments, the communication between the credential reader 104 and the access controller 106 is performed via a cryptographically secured protocol. In embodiments, the cryptographically secured protocol is the Open Supervised Device Protocol (OSDP). OSDP is performed via communication interfaces 110 and 136. In embodiments, these interfaces support the RS-485 communication standard. The communication interfaces 110 and 136 enable bidirectional communication. In this way, utilizing the credential reader 104 and access controller 106 can support advanced security features such as methods of implementing encryption, key management, and authentication on an OSDP connection. OSDP can support security features such as AES-128 encryption and Cipher-based Message Authentication Code (CMAC) chaining to improve overall security of the access control system for premises.

In the event that a malicious actor attempts to tamper with the credential reader 104, a tamper detection signal is sent from the credential reader 104 to the access controller 106. The access controller 106 can then, in response, send a notification to an external computing device, including, but not limited to, a headend controller, cloud-based service, e-mail server, mobile computing device (e.g. mobile phone, tablet computer, etc.), or other suitable external computing device. In this way, administrators, monitoring services, and/or other stakeholders can be notified in real-time of the tampering.

The primary credential reader 104 may be used on a first side of a door. Users on the first side of the door present their credentials to the primary credential reader to gain access to the second side. Optionally, a secondary credential reader 108 may be used on the second side of the door. The secondary credential reader 108 is similar to the primary credential reader 104. In some cases, the secondary credential reader serves as a request to exit (REX) reader. An example usage may include a warehouse or factory. In such cases, where expensive inventory is present, it may be desirable to track both entry to a secure area as well as exit from the secure area. In such embodiments, the secondary credential reader 108 may communicate with the access controller 106 via a serial communication protocol such as RS-485.

The access controller 106 includes a processor 120, and memory 122 that is coupled to the processor 120. The memory 122 contains instructions, which when executed by the processor, perform steps in accordance with embodiments of the present invention. In embodiments, the memory 122 may include random-access memory, read-only memory, flash, and/or other suitable memory type. Access controller 106 may further include non-volatile storage such as battery-backed SRAM, magnetic storage, and/or other suitable storage type. The access controller 106 may further include protected storage 132. In embodiments, protected storage 132 may include an encrypted memory for storing cryptographic keys, hashes, and/or other sensitive information. In embodiments, the protected storage 132 is accessible from the processor 120 on a dedicated internal bus for additional security. In embodiments, memory 122, non-volatile storage 126, and protected storage 132 are non-transitory computer readable medium containing machine instructions and/or data. In embodiments, the protected storage 132 may include a cryptographic co-processor with secure hardware-based key storage. The protected storage 132 may be configured to store multiple encryption keys, certificates, and/or data. In some embodiments, the protected storage 132 may implement hardware support for asymmetric signing, key agreement, ECDSA: FIPS186-3 elliptic curve digital signature, ECDH: FIPS SP800-56A elliptic curve Diffie-Hellman, NIST Standard P256 elliptic curve support, and/or other suitable protocols. In embodiments, the processor 120 may execute instructions to retrieve cryptographic keys from the cryptographic co-processor. The cryptographic keys may be used as part of the authentication process.

The secondary credential reader 108 includes a communication interface 142. The communication interface 142 may include an RS-485 interface, as well as a wireless communication interface such as Bluetooth, Zigbee, or other suitable protocol. The secondary credential reader 108 may include a legacy transceiver 144. The legacy transceiver 144 may be used to support legacy credentials operating at 125 kHz. The secondary credential reader 108 includes a high frequency transceiver 146. The high frequency transceiver 146 may operate at 13.56 MHz or 2.4 GHz, or other suitable range. In some embodiments, the high frequency transceiver may operate at a frequency range between 300 MHz and 3 GHz. Embodiments may include a Bluetooth Low Energy (BLE) transceiver 145 operating at the 2.4 GHz range. One or more light emitting diodes (LEDs) 148 may be present on the secondary credential reader 108. The LEDs 148 may indicate a variety of conditions, including, but not limited to, a power-on state, a credential detect state, an unlocked state, a locked state, and/or a variety of other conditions. A tamper detection circuit 155 may also be installed on a circuit board within the credential reader 108. In embodiments, the tamper detection circuit comprises an accelerometer. In embodiments, the accelerometer may be a 3-axis accelerometer that is capable of detecting motion in any direction. In the event that a malicious actor attempts to remove or damage the credential reader 108, that activity will cause motion that is detected by the tamper detection circuit 155. In some embodiments, the credential reader 108 may include a microcontroller 109, which contains a processing element, memory, storage, input/output, and/or other peripherals to operate elements of the credential reader, including the LEDs 148 and tamper detection circuit 155.

In some embodiments, the microcontroller 109 within the credential reader 108 contains instructions, that when executed by the microcontroller 109, send a message to the access controller 106 in response to detecting a tamper signal from tamper detection circuit 155. In embodiments, the communication between the credential reader 108 and the access controller 106 is performed via a cryptographically secured protocol. In embodiments, the cryptographically secured protocol is the Open Supervised Device Protocol (OSDP). OSDP is performed via communication interfaces 142 and 136. In embodiments, these interfaces support the RS-485 communication standard. The communication interfaces 142 and 136 enable bidirectional communication. In this way, utilizing the credential reader 108 and access controller 106 can support advanced security features such as methods of implementing encryption, key management, and authentication on an OSDP connection.

In the event that a malicious actor attempts to tamper with the credential reader 108, a tamper detection signal is sent from the credential reader 108 to the access controller 106. The access controller 106 can then, in response, send a notification to an external computing device, including, but not limited to, a headend controller, cloud-based service, e-mail server, mobile computing device (e.g. mobile phone, tablet computer, etc.), or other suitable external computing device. In this way, administrators, monitoring services, and/or other stakeholders can be notified in real-time of the tampering.

The access controller 106 includes a processor 120, which is coupled to memory 122. Memory 122 contains instructions, that when executed by the processor, perform steps in accordance with embodiments of the present invention. The memory 122 may be a non-transitory computer-readable medium, including, but not limited to, flash memory, EEPROM, SRAM, optical storage, magnetic storage, or other suitable technology.

The access controller 106 can further include non-volatile storage 126. The non-volatile storage 126 can include battery-backed SRAM (static random-access memory), flash, magnetic storage, or other suitable storage technology.

The access controller 106 can further include protected storage 132. This may include a region of read-only memory that includes a unique identifier (UID) such as a MAC address, serial number, or other suitable identifier, as well as security certificates. This can enable secure communication between the access controller 106 and the credential readers 104 and 108, including encrypted and/or digitally signed messages exchanged between the electronic credential readers 104 and 108, and the access controller 106 via communication interface 136. Communication interface 136 can include an RS-485 interface, an Ethernet interface, and/or a wireless communication interface (e.g. Wi-Fi, Bluetooth, Zigbee, or the like). Thus, in embodiments, the communication interface includes an RS-485 interface. In other embodiments, the communication interface includes a Bluetooth interface. The Bluetooth interface can enable remote diagnostics to a laptop computer, tablet computer, smartphone, or other suitable device.

Embodiments can include a proximal motion detection circuit 118. In some embodiments, the proximal motion detection circuit includes a passive infrared sensor. The proximal motion detection circuit 118 can detect motion, such as that of a person, in proximity to the integrated access system. In some embodiments, the proximal motion detection circuit asserts a signal when a user is within two meters of the integrated access system. In embodiments, the proximal motion detection circuit 118 is utilized to activate various power saving features.

Embodiments can include a tamper detection circuit 124. In embodiments, the tamper detection circuit comprises an accelerometer. In embodiments, the accelerometer may be a 3-axis accelerometer that is capable of detecting motion in any direction. In the event that a malicious actor attempts to remove or damage the integrated access system 102, that activity will cause motion that is detected by the tamper detection circuit 124. In other embodiments, the tamper detection circuit 124 may include a different type of motion detection, including, but not limited to, ultrasound, infrared, or other suitable technique. The tamper detection circuit asserts a signal that is received by the processor 120. Upon receiving the tamper signal, the processor 120 places the access controller in a lockdown mode. The transition to lockdown mode can include several actions, including, but not limited to, reporting the tamper event to a remote computer such as headend controller 502, clearing user data from non-volatile storage 126, and/or performing a factory reset, which resets the access controller to factory conditions. In embodiments, the electrically activated lock 150 may be set to a locked configuration upon detecting a tamper signal. In embodiments, the access controller 106 may be restored to normal functionality by sending a special data packet from the headend controller 502 that contains a data field that hashes to a value stored in protected storage 132. In embodiments, protected storage 132 contains data written from the factory. The factory may also provide (e.g. on a label, digital file, or other suitable location) a data string that hashes to the value in protected storage. In these embodiments, the malicious actor can not restore the access controller to normal operation once the tamper signal has been activated so long as the data string is kept confidential.

In some embodiments, the integrated access system 102 may also be equipped with a keypad 128. The keypad 128 may include a numeric keyboard, an alphanumeric keyboard, or other combination of buttons, and keys including numbers, letters, and/or symbols.

In some embodiments, the integrated access system 102 may also be equipped with a buzzer 130. The buzzer 130 may be used to indicate warning conditions to nearby users. In some embodiments, a speaker may be used in place of, or in addition to a buzzer.

In some embodiments, the integrated access system 102 may also be equipped with a temperature detection circuit 134. In embodiments, the temperature detection circuit 134 comprises a thermocouple. Since disclosed embodiments are intended to be used in confined areas such as a single gang box, efficient thermal management is important for reliable and consistent operation. For example, under normal conditions, the ambient temperature may allow normal operation. However, in the event of a prolonged HVAC failure in a facility in a warm climate, the ambient indoor temperature can rise considerably. While the integrated access system 102 may function normally with an indoor ambient temperature of 70F, the operating conditions may be exceeded with an indoor ambient temperature of 90F (caused by an HVAC failure). To accommodate these types of situations, disclosed embodiments provide a variety of thermal management techniques to reduce the amount of power consumed, and thus, heat generated, by the integrated access system 102, in order to prevent component failure while still providing a level of security and functionality.

In some embodiments, the integrated access system 102 may also be equipped with a power monitoring circuit 138. The power monitoring circuit 138 is configured and disposed to detect a dip and/or interruption in power. The power monitoring circuit 138 may assert a signal that is received by the processor 120. Upon receiving the low power signal, the processor 120 places the access controller in a low power mode. The transition to low power mode can include several actions, including, but not limited to, switching to a battery power source, setting a reduced transceiver activity mode, reducing processor clock speed, and/or setting a lock force reduction mode.

The access controller 106 further includes a lock interface 140. Lock interface 140 includes the circuitry necessary to activate the electrically activated lock 150. The electrically activated lock 150 may include a magnetic lock, electric strike, or other suitable electrically activated lock type.

Figure 1B:
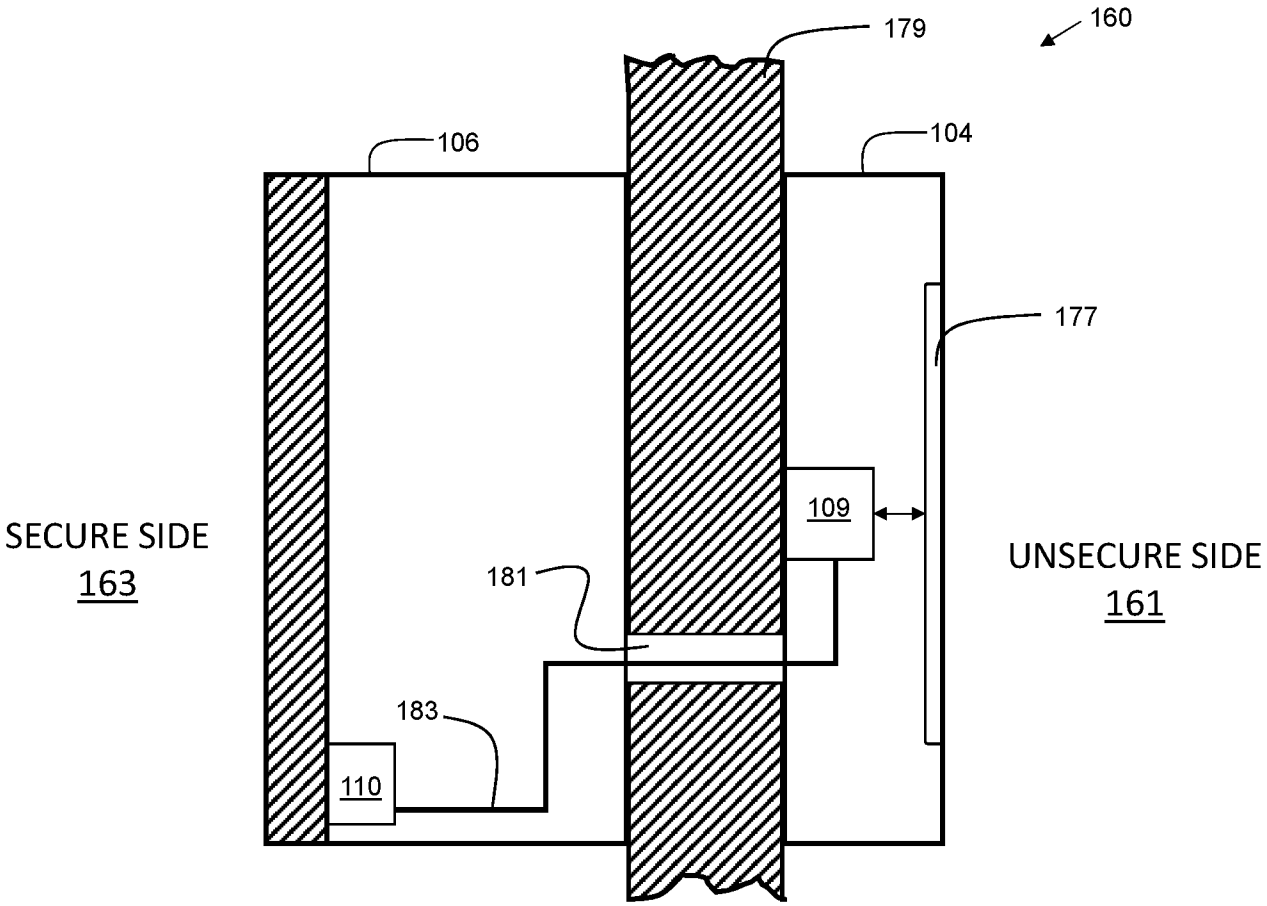
FIG. 1B shows a side view of an exemplary installation of an embodiment of the present invention.

FIG. 1B shows a side view of an exemplary installation 160 of an embodiment of the present invention. A physical barrier 179 such as a wall, fence, or other suitable barrier defines a secure side 163 of a premises and an unsecure side 161 of a premises. The credential reader 104 is installed on the unsecure side 161 of a premises. Credential reading hardware 177 such as a scanner, antenna, or other suitable device is disposed on the unsecure side 161 of the premises. During the installation process, a small through-hole or conduit 181 may be formed within barrier 179 to enable signal cable 181 to provide electronic communication between the credential reader 104 and the access controller 106. In the event that a malicious actor attempts to uninstall, damage, or in any way move the credential reader 104, the tamper detection circuit 135 asserts a signal that is received by processor 120 of access controller 106. The access controller 106 can, in response to this signal, send an electronic notification to one or more external computers to notify additional stakeholders, and/or take a mitigation action (e.g. locking down the facility by disabling one or more credential readers). In this way, an improved level of security is achieved, while providing a convenient form factor for installation in standard electrical junction boxes. Thus, in embodiments, the memory 122 of the access controller 106 contains instructions, that when executed by the processor, in response to receiving a tamper detection signal from a credential reader, send an electronic notification to an external computer.

Figure 2C:
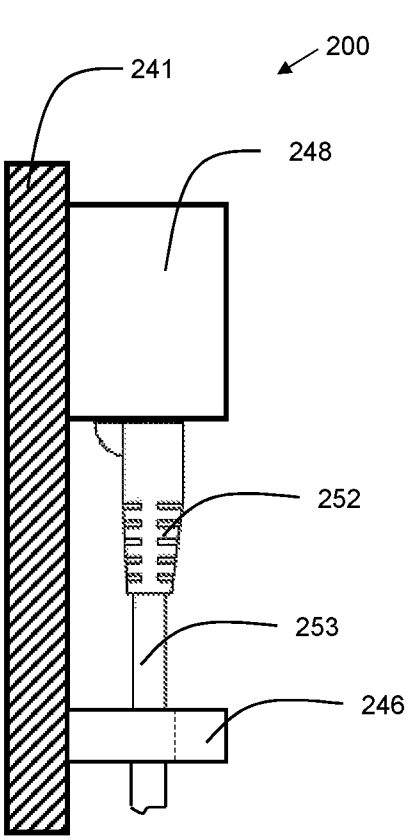
FIGS. 2A-2D show views of an exemplary input/output circuit board in accordance with embodiments of the present invention.
Figure 2B:
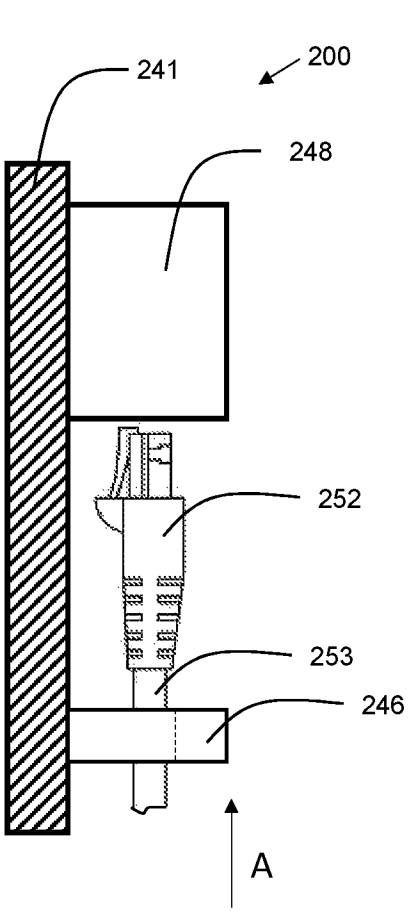
Figure 2A:
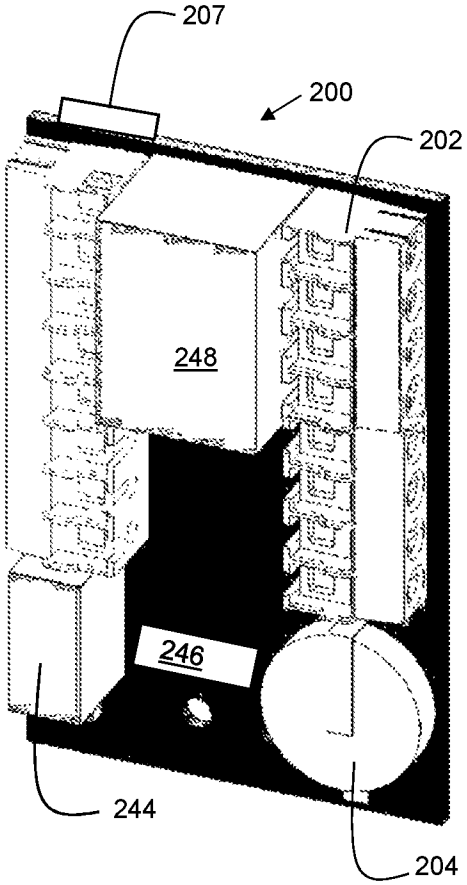

FIG. 2A shows an exemplary input/output circuit board 200 in accordance with embodiments of the present invention. Circuit board 200 may include a battery 204. The battery 204 may be a coin cell battery. In embodiments, the battery 204 is used to preserve the contents of non-volatile storage 126 when power is disconnected from the integrated access system 102. Circuit board 200 also includes an input/output (I/O) connector block 202. The connector block 202 includes one or more terminals for connection of various signals associated with the access controller 106. These signals can include, but are not limited to, a Request to Exit switch signal (REX), a Door Position switch signal (DM), and an auxiliary input (Aux). Additional inputs can include an auxiliary 12V power input to allow the integrated access system 102 to be powered by a local DC power supply. The connector block 202 can further include interface outputs for door control. These outputs may be configured by form C relay 244 to produce signals such as Normally Closed (N/C), Normally Open (N/O), Common (C), and a multiplexed +12V output to control electrically activated lock 150, which may include a magnetic lock and/or electric strike. In embodiments, the form C relay 244 is mounted to the circuit board 200 as a through-hole mount, in which pins from the relay traverse the circuit board and are soldered on the opposite side, to provide improved physical robustness as compared with a surface mounted part. Thus, in embodiments, the circuit board further comprises a through-hole form C relay.

Figure 2D:
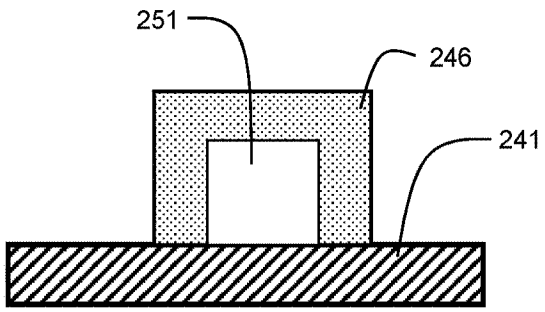

Circuit board 200 also includes a network connector 248. In embodiments, network connector 248 is an Ethernet connector, which in some embodiments, may be an RJ45 connector. The network connector 248 provides network connectivity to other devices in the network, such as a headend controller. The circuit board 200 may also include a strain relief 246. As shown in FIG. 2B, as part of installation, a network cable 253 is installed such that is it constrained by the strain relief 246. FIG. 2C shows the installed configuration, in which the network plug 252 is inserted into the network connector 248, with the strain relief 246 constraining the network cable 253 at the end of the circuit board 200 that is opposite to the network connector 248. In this way, stress on the network connector 248 is reduced, reducing the chance of separation of the network connector 248. Thus, the strategic use and position of the strain relief improved reliability. Thus, embodiments include a circuit board; a network connector disposed on the circuit board; a strain relief disposed on the network connector, wherein the strain relief is configured and disposed to constrain a cable inserted in the network connector. In some embodiments, the strain relief 246 and network connector 248 are separated by a distance ranging from 2 centimeters to 5 centimeters. FIG. 2D shows a view of circuit board 200 as viewed from the direction of arrow A of FIG. 2B. In this view, the strain relief 246 is shown to have an opening 251 through which the network cable 253 (FIG. 2C) can pass when the embodiments of the present invention are installed.

Figure 3:
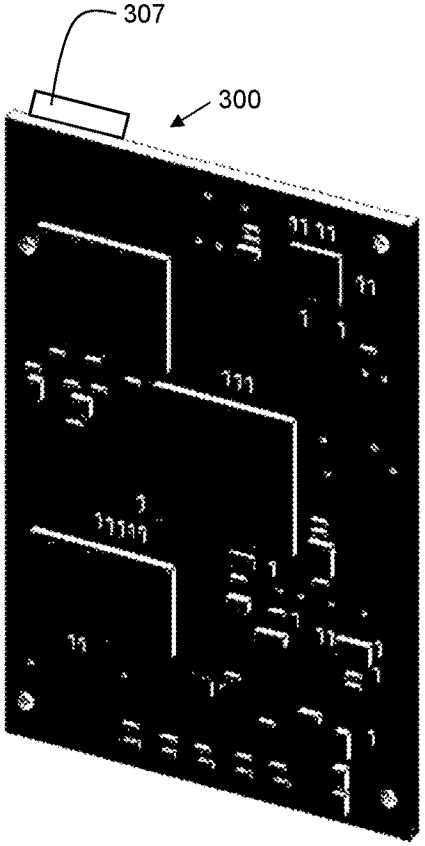
FIG. 3 shows an exemplary processor circuit board in accordance with embodiments of the present invention.

FIG. 3 shows an exemplary processor circuit board 300 in accordance with embodiments of the present invention. The processor may include a microprocessor, microcontroller, or other suitable processor. In embodiments, the processor integrated circuit may include multiple cores, cache memories, input/output circuitry, and/or other functional circuitry. In embodiments, circuit board 300 includes connector 307. When assembled, connector 307 connects to corresponding connector 207 of circuit board 200, allowing one or more electronic/electrical signals to pass to/from the processor circuit board 300 and the input/output circuit board 200.

Figure 4:
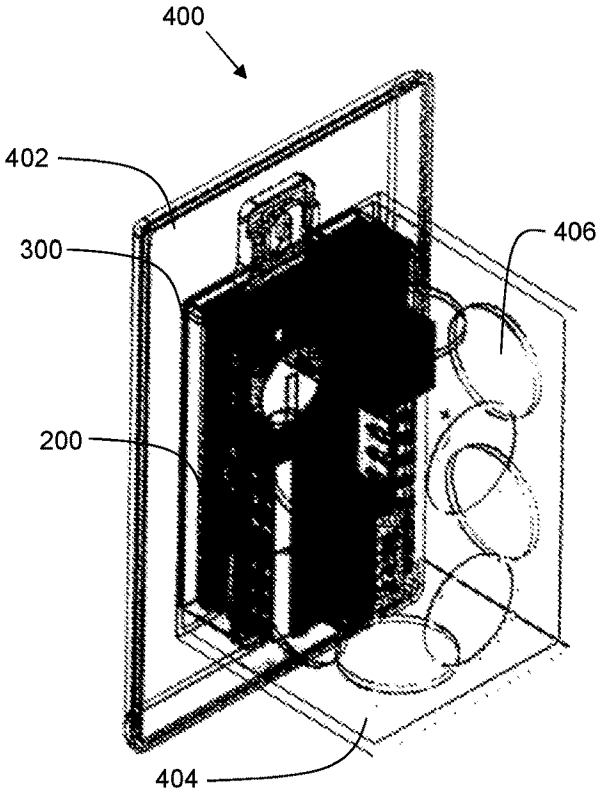
FIG. 4 shows an integrated access system in accordance with embodiments of the present invention utilizing the circuit boards of FIGS. 2 and 3 in a single gang box enclosure.

FIG. 4 shows an integrated access system 400 in accordance with embodiments of the present invention utilizing the circuit boards 200 and 300 of FIG. 2 and FIG. 3, respectively, in a single gang box enclosure 404. In embodiments, the single gang box enclosure 404 may have a plurality of vents 406 to allow heat to escape. As installed in a facility, the single gang box enclosure 404 may be affixed to a wall and covered by a faceplate 402.

Embodiments include a first circuit board 200 and a second circuit board 300, in which the first circuit board is configured to electrically connect to the second circuit board via connectors 207 and 307, and physically mounted parallel to the second circuit board such that the integrated access system is mountable within a single gang box enclosure.

Figure 5:
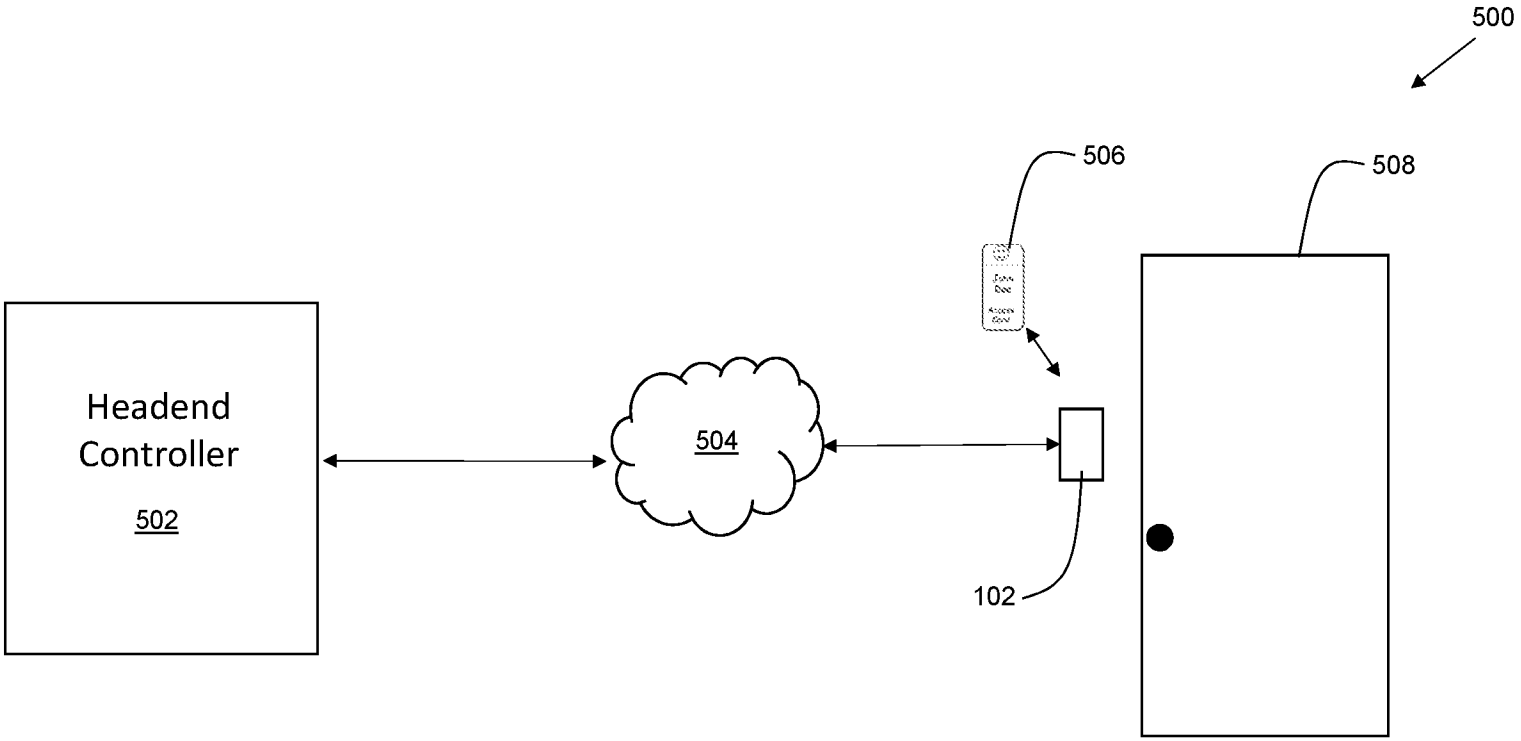
FIG. 5 is a system diagram of an embodiment of the present invention.

FIG. 5 is a system diagram 500 of an embodiment of the present invention. The integrated access system 102 may be connected to network 504, to enable communication with a headend controller 502. The headend controller 502 may be a computer system used to perform administrative functions such as adding and removing of users, editing the permissions of existing users, and/or collecting data and generating reports regarding user access of a given facility. When a credential 506 is presented to the integrated access system 102, the integrated access system 102 operates an electrically activated lock to allow the door 508 to be opened. The headend controller 502 may store a record of entry and/or exit times for each credential holder.

Figure 6:
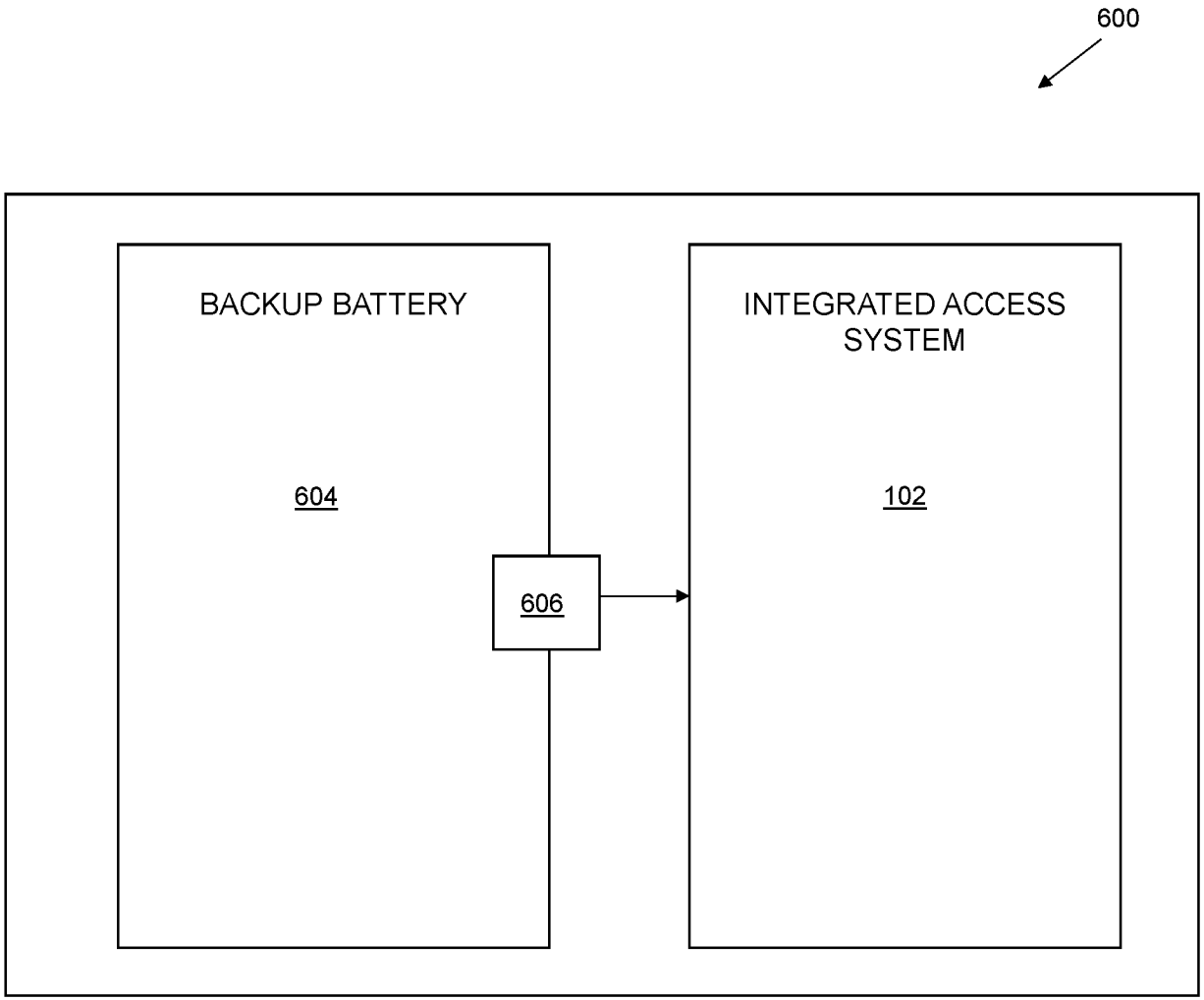
FIG. 6 shows an additional embodiment of the present invention in a double gang box enclosure with an auxiliary power source.

FIG. 6 shows an additional embodiment 600 of the present invention in a double gang box enclosure with an auxiliary power source. The integrated access system 102 fits in part of the double gang box enclosure. A backup battery 604 fits in another part of the double gang box enclosure, and is coupled to the integrated access system 102 via a failover circuit 606. The failover circuit 606 detects the status of AC power, and provides power from battery 604 when AC power is disrupted for any reason. Upon detection of a power disruption, the integrated access system 102 operates in low power mode. In low power mode, various strategies are employed to reduce the power consumption of the integrated access system 102, to prolong the operating time in low power mode before the battery 604 is depleted.

Figure 7:
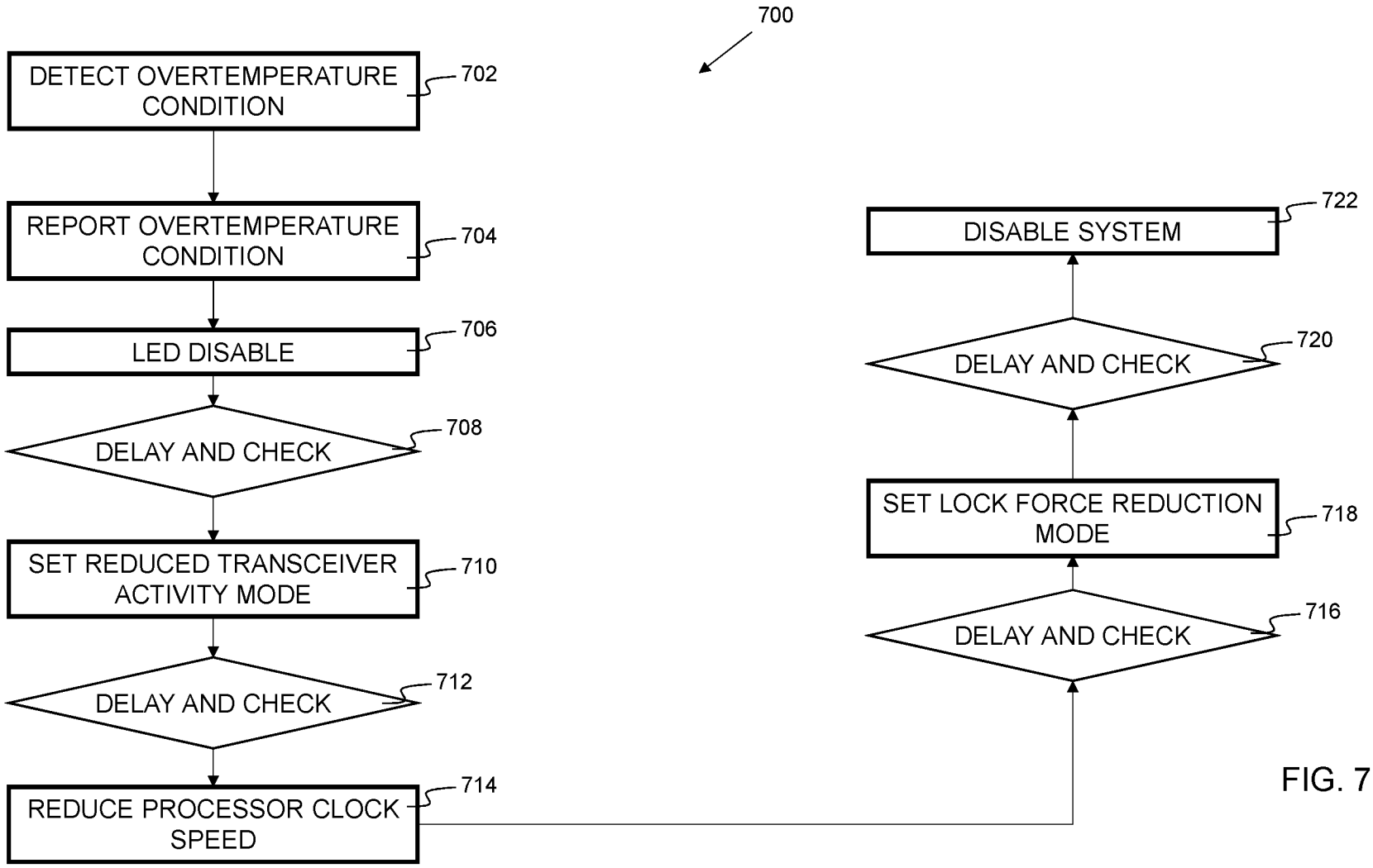
FIG. 7 is a flowchart indicating process steps for overtemperature processing in accordance with embodiments of the present invention.

FIG. 7 is a flowchart 700 indicating process steps for overtemperature processing in accordance with embodiments of the present invention. In process step 702, an overtemperature condition is detected, based on an output of temperature circuit 134. In embodiments, the temperature circuit 134 is configured to assert an electronic signal when the temperature within the enclosure 404 exceeds a predetermined threshold. In embodiments, the predetermined threshold is 85 degrees Celsius. Other thresholds may be used in some embodiments. Some embodiments may have multiple thresholds, with different temperature reducing steps being applied as each of the multiple thresholds is reached. In process step 704, the overtemperature condition is reported. In embodiments, this may be performed by sending a message to a remote computing device such as headend controller 502. Embodiments may then perform one or more steps to reduce the operating temperature of the integrated access system 102. At process step 706, LEDs are disabled to reduce heat generation. At process step 708, a delay and check step is performed. The delay and check step delays for a predetermined time interval (e.g. 30 seconds), and then checks the operating temperature via the temperature circuit 134. If the operating temperature is continuing to increase after performing process step 706, then the process proceeds to process step 710, where a reduced transceiver activity mode is set. Thus, embodiments can include setting a reduced transceiver activity mode. In the reduced transceiver activity mode, the integrated access controller system 102 shortens the time the transceivers are transmitting at each frequency, for the purposes of reducing power consumption, and thusly, heat generation. When operating in the reduced transceiver activity mode, and the integrated access system 102 detects the presence of a credential in the reader field, the credential reader (104 or 108) then switches from the reduced transceiver activity state to a normal activity state only long enough to read the card and send the data to the access controller 106. At process step 712, another delay and check step is performed. If the operating temperature is continuing to increase after performing process step 710, then the process proceeds to process step 714, where the processor clock speed is reduced. Underclocking is another power/heat reduction technique that may be employed in some embodiments. As an example, the clock speed of the processor 120 may be reduced from 2 GHz to 1.6 GHz to save power and/or reduce heat generation.

At process step 716, another delay and check step is performed. If the operating temperature is continuing to increase after performing process step 714, then the process proceeds to process step 718 where the lock force reduction mode is set in process step 718. When in the lock force reduction mode, the integrated access controller system 102 pulse width modulates the power being supplied to a magnetic lock or electric strike resulting in reduced "hold force" of the lock but also saving power consumption and thusly, reducing heat generation. In this case, the door is still locked, but with less force (e.g. for a magnetic lock) than normally. In some embodiments, when the integrated access controller system 102 is operating in lock force reduction mode, it utilizes the proximal motion detect circuit 118 to determine if a person is nearby the integrated access controller system 102. If a person is detected nearby, then the integrated access controller system 102 temporarily exits lock force reduction mode for a predetermined amount of time (e.g. 15 seconds). In this way, power savings and heat reduction is obtained, but the normal lock force is temporarily restored if a person is nearby and could potentially attempt to open the door. At process step 720, another delay and check step is performed. If the operating temperature is continuing to increase after performing process step 718, then the process proceeds to process step 722, where the system is disabled. This is typically a last resort to prevent permanent component damage due to excessive heat. Embodiments include detecting an overtemperature condition from the temperature detection circuit; sending an overtemperature alert message to a remote computing device; and disabling the one or more light emitting diodes in response to the overtemperature condition. If the overtemperature condition resolves, embodiments restore normal functionality. The LEDs may reactivate, and other heat reduction steps may be reverted, and the integrated access controller system 102 returns to normal operating mode. In some embodiments, not all steps shown in flowchart 700 may be executed. As an example, if, after step 710, the overtemperature issue is resolved (e.g. by repairing the HVAC system to lower the ambient temperature), then the process does not execute any additional temperature reducing steps such as that shown in 714 and 718, but instead, reverts to normal operating mode.

Figure 8:
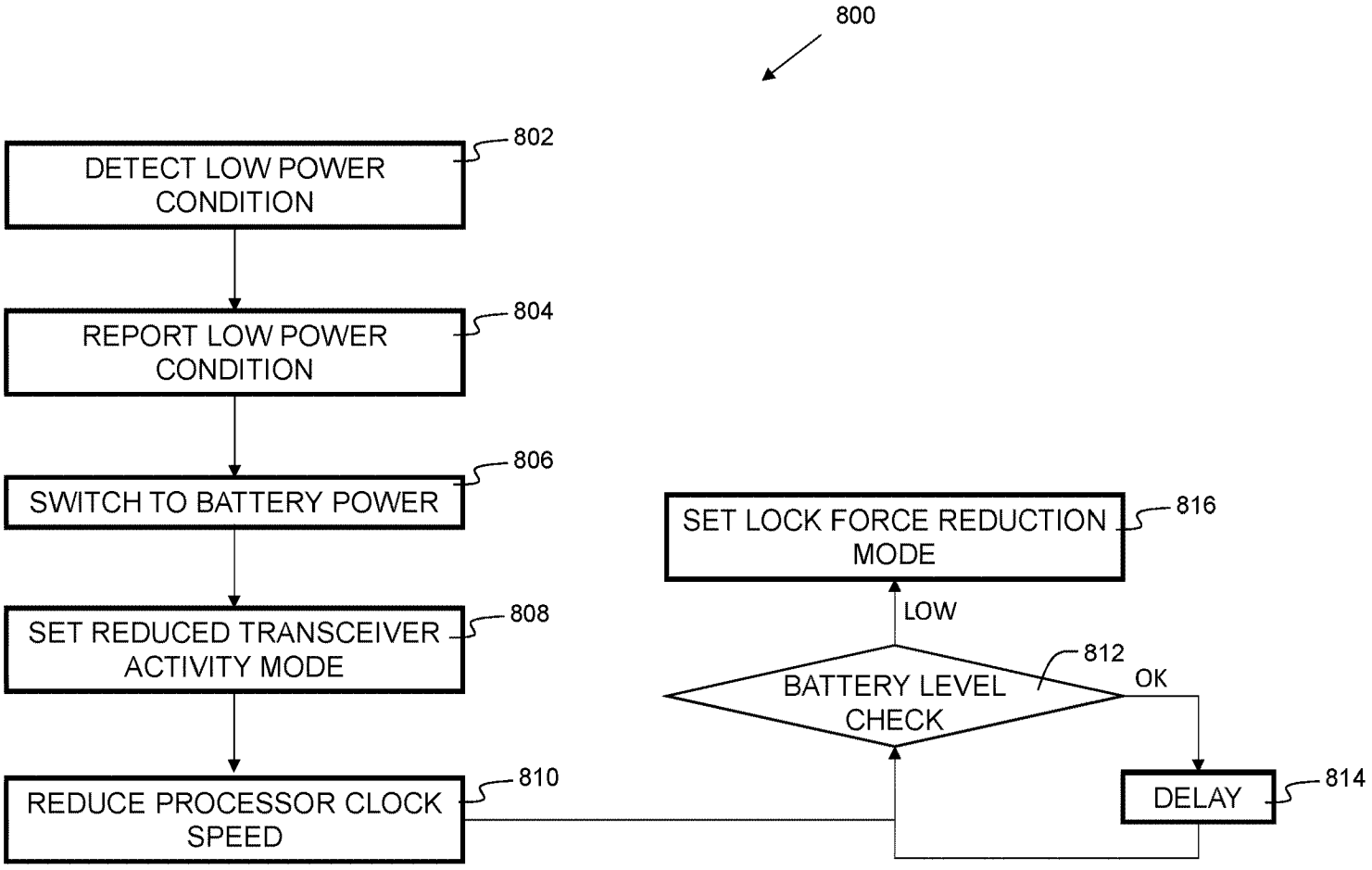
FIG. 8 is a flowchart indicating process steps for low power processing in accordance with embodiments of the present invention.

FIG. 8 is a flowchart 800 indicating process steps for low power processing in accordance with embodiments of the present invention. In process step 802, a low power condition is detected using power monitoring circuit 138. The low power condition can include a loss of AC power, a decrease in AC power, and/or a decrease in battery power. In process step 804, a low power condition is reported to a remote computing device, such as headend controller 502. In process step 806, in the event of a loss of AC power, the integrated access system 102 may switch to battery power. The battery can be a battery disposed within a dual gang compartment.

Embodiments can include detecting a low power condition from the power monitoring circuit; sending a low power condition message to a remote computing device; and reducing a clock speed of the processor in response to the low power condition. Embodiments may further include setting reduced transceiver activity mode at process step 808. When operating in the reduced transceiver activity mode, and the integrated access system 102 detects the presence of a credential in the reader field, the credential reader (104 or 108) then switches from the reduced transceiver activity state to a normal activity state only long enough to read the card and send the data to the access controller 106.

Embodiments may further include reducing processor clock speed at process step 810. Underclocking is another power/heat reduction technique that may be employed in some embodiments. As an example, the clock speed of the processor 120 may be reduced from 2 GHz to 1.6 GHz to save power and/or reduce heat generation.

Embodiments may further include performing a battery level check at process step 812. If the battery is at an acceptable voltage level, then the process continues to process step 814, where the process waits a predetermined delay (e.g. 300 seconds), and then does another battery level check. This process continues until AC power is restored. If the battery level check indicates that the battery is low, then the process continues to process step 816 where the lock force reduction mode is set. Thus, embodiments can include setting a lock force reduction mode in response to the low power condition. When in the lock force reduction mode, the integrated access controller system 102 pulse width modulates the power being supplied to a magnetic lock or electric strike resulting in reduced "hold force" of the lock but also saving power consumption and thusly, reducing heat generation. In this case, the door is still locked, but with less force (e.g. for a magnetic lock) than normally. In some embodiments, when the integrated access controller system 102 is operating in lock force reduction mode, it utilizes the proximal motion detect circuit 118 to determine if a person is nearby the integrated access controller system 102. If a person is detected nearby, then the integrated access controller system 102 temporarily exits lock force reduction mode for a predetermined amount of time (e.g. 15 seconds). In this way, power savings and heat reduction is obtained, but the normal lock force is temporarily restored if a person is nearby and could potentially attempt to open the door.

Figure 9:
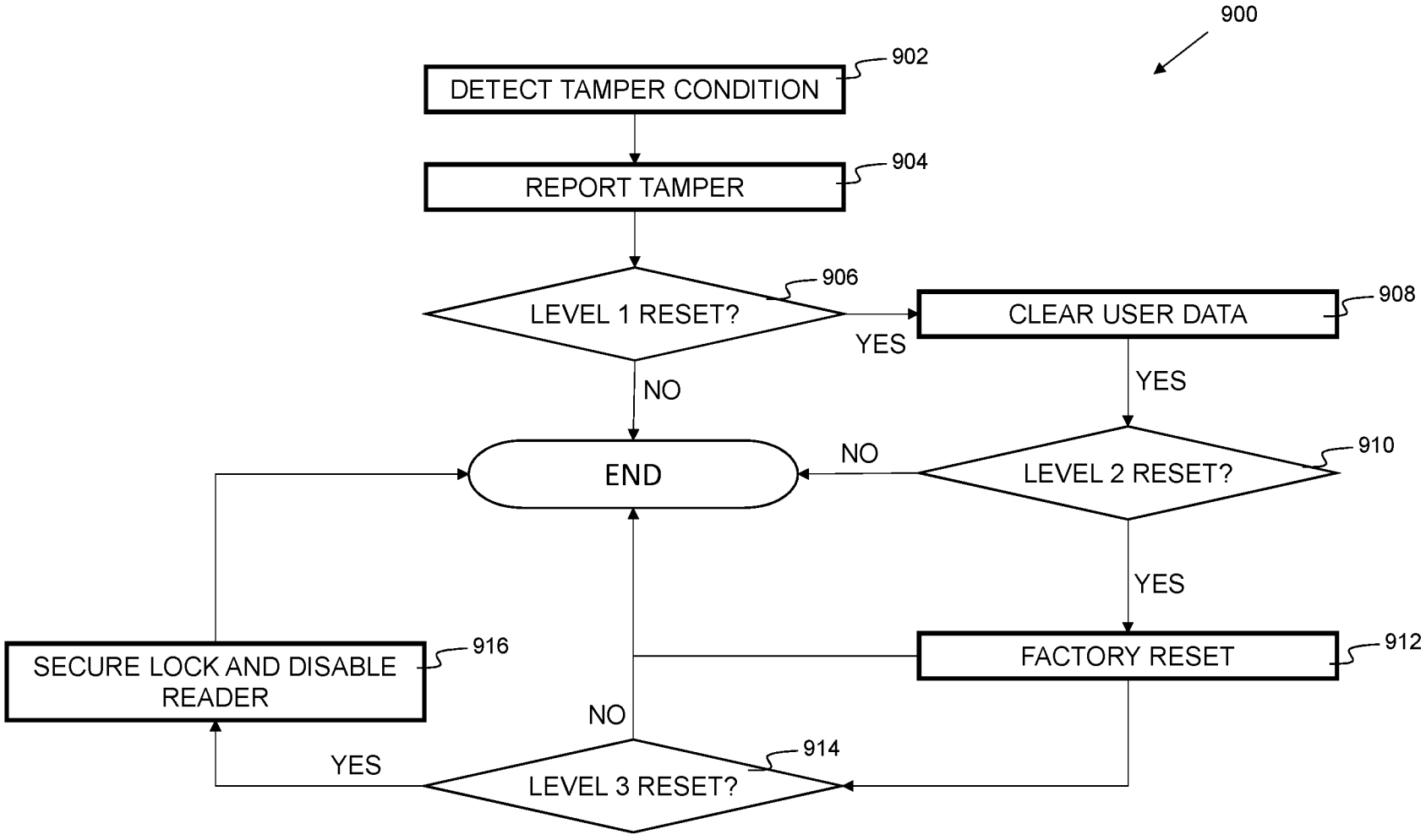
FIG. 9 is a flowchart indicating process steps for tamper detection processing in accordance with embodiments of the present invention.

FIG. 9 is a flowchart 900 indicating process steps for tamper detection processing in accordance with embodiments of the present invention. In process step 902, a tamper condition is detected via tamper detection circuit 124. In embodiments, the tamper detection circuit 124 includes an accelerometer. The accelerometer can detect motion associated with tampering and assert a tamper detect signal in response to the motion. The processor 120, upon detecting the tampering, reports the tampering at process step 904 by sending a message to a remote computing device such as headend controller 502. In embodiments, a configuration option enables one or more actions to be taken, based on administrator preferences. At 906, a check is made to determine if a level 1 reset is enabled. If not, the process ends. If yes, then the process continues to process step 908, where user data is cleared from memory. At process step 910, a check is made to determine if a level 2 reset is enabled. If not, the process ends. If yes, then the process continues to process step 912, where a factory reset is performed. The factory reset restores all settings to default values. At process step 914, a check is made to determine if a level 3 reset is enabled. If not, the process ends. If yes, then at process step 916, the electrically activated lock 150 is set to a locked configuration, and the credential readers are disabled. This serves as a security measure to prevent access in response to detecting a tamper condition. Thus, embodiments can include detecting a tamper condition from the tamper detection circuit; and sending a tamper alert message to a remote computing device in response to detecting the tamper condition. Embodiments can include performing a user data reset in response to detecting the tamper condition. Embodiments can further include locking the electronically activated lock; and disabling the one or more credential transceivers in response to detecting the tamper condition.

Figure 10:
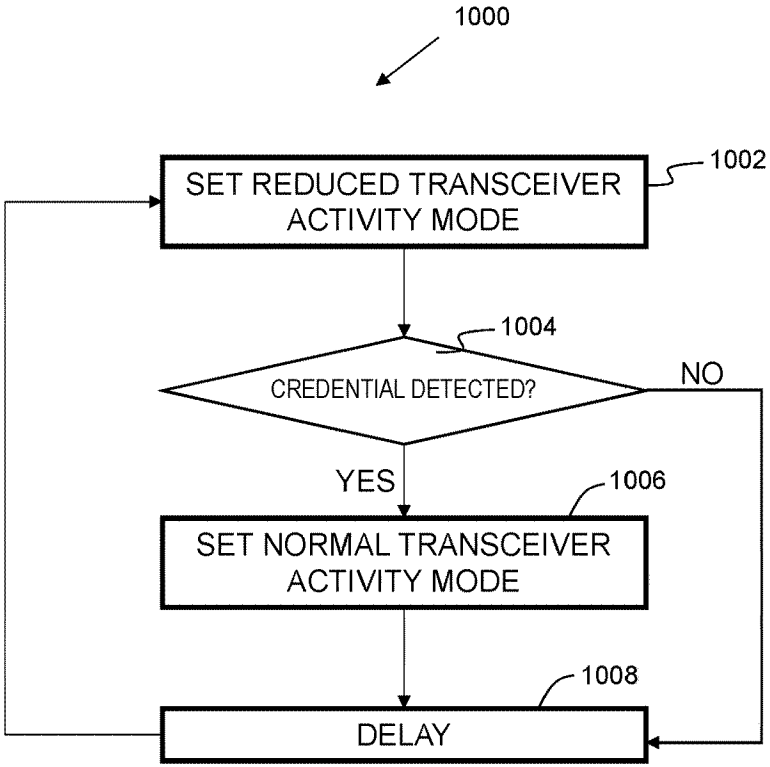
FIG. 10 is a flowchart showing details of reduced transceiver activity mode processing.

FIG. 10 is a flowchart 1000 showing details of reduced transceiver activity mode processing. In process step 1002, reduced transceiver activity mode is set. When in reduced transceiver activity mode, there is a reduction in the time the transceivers are transmitting at each frequency, for the purposes of reducing power consumption, and thusly, heat generation. When operating in the reduced transceiver activity mode, and the integrated access system 102 detects the presence of a credential in the reader field, the credential reader (104 or 108) then switches from the reduced transceiver activity state to a normal activity state only long enough to read the card and send the data to the access controller 106. In process step 1004, a check is performed to see if a credential is detected. If a credential is proximal to the credential reader, then the credential is detected, and the process proceeds to process step 1006, where the normal activity mode is set, increasing the amount of transceiver activity so the credential data can be quickly read from the credential. In embodiments, the credential is in the form of an access card. In embodiments, the access card is considered proximal when it is placed within ten centimeters of the reader. Some embodiments may use a shorter distance to be considered proximal. Other embodiments may detect credentials at a longer distance. Thus, the proximal distance of ten centimeters is exemplary. Embodiments can include reverting the reduced transceiver activity mode for a predetermined duration in response to detecting a proximal access card from the one or more credential transceivers. The process then proceeds to 1008 where a delay for a predetermined time period is executed. In embodiments, the delay at process step 1008 may range from 10 seconds to 60 seconds. Other values for the delay are possible.

Figure 11:
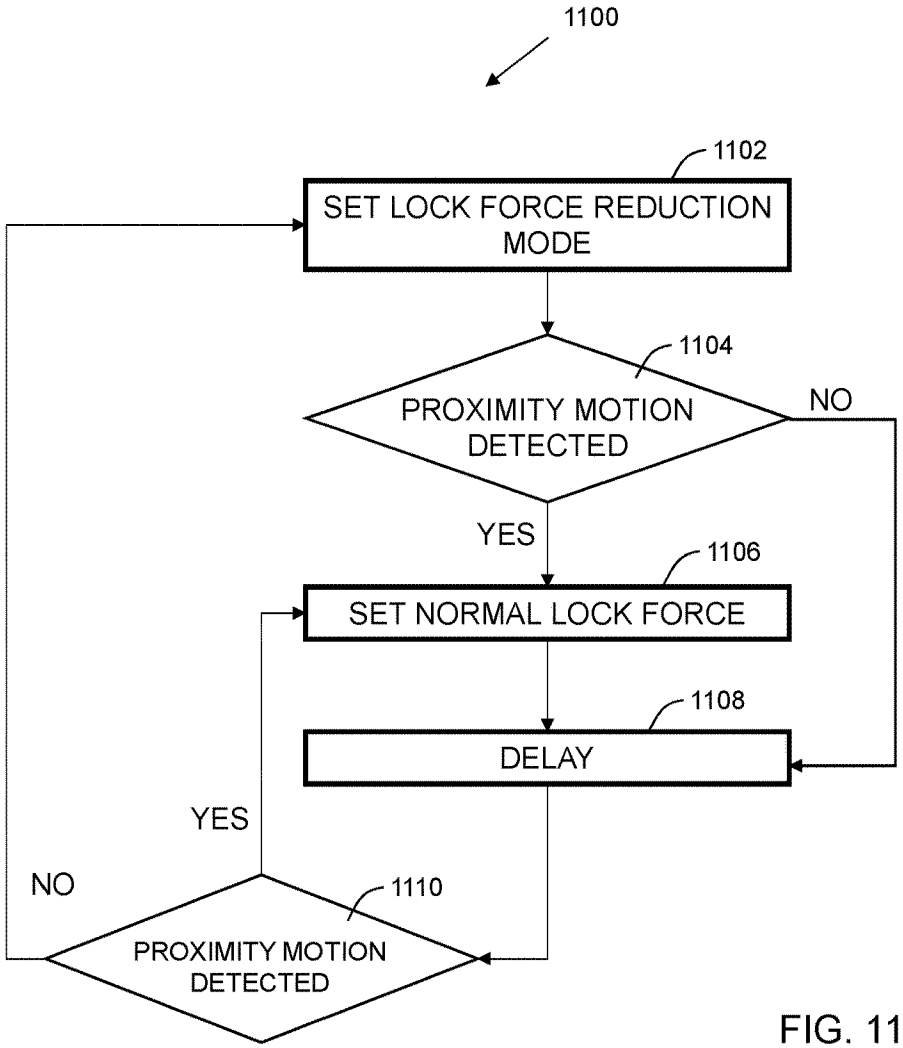
FIG. 11 is a flowchart showing details of lock force reduction mode processing.

FIG. 11 is a flowchart 1100 showing details of lock force reduction mode processing. In process step 1102, a lock force reduction mode is set. In embodiments, this mode may be set as part of a power saving mechanism. The power saving mode may be invoked by the processor 120 when the processor 120 detects a loss or reduction in power from the power monitoring circuit 138. When in the lock force reduction mode, the integrated access controller system 102 pulse width modulates the power being supplied to a magnetic lock or electric strike resulting in reduced "hold force" of the lock but also saving power consumption and thusly, reducing heat generation. In this case, the door is still locked, but with less force (e.g. for a magnetic lock) than normally. In process step 1104, a check is made to determine if proximity motion is detected. Proximity motion is motion within a predetermined distance of the integrated access system 102, such that it is detectable by proximal motion detection circuit 118. In embodiments, the predetermined distance ranges from one centimeter to 3 meters from the integrated access system 102. If proximity motion is detected, then normal lock force is temporarily set at 1106. The process then proceeds to process step 1108 for a predetermined delay period. In embodiments, the predetermined delay period is five seconds. After the predetermined delay period, another check is made for proximity motion detection at process step 1110. If no proximity motion is detected, then the process returns to process step 1102, and lock force reduction mode is set again. If proximity motion is detected, then the process returns to process step 1106, where normal lock force is set. In this way, when a person walks nearby the integrated access system 102, the lock force is set to its normal (stronger) force to prevent unauthorized entry. If the person walks past the integrated access controller system 102 and out of range of the proximal motion detection circuit 118. Then the lock force mode is set to the lock force reduction mode. This conserves power and reduces heat generation, by reducing the lock force when people are not nearby the integrated access controller system 102, and thus, there is less of a need for lock force. Thus, embodiments can include reverting the lock force reduction mode in response to detection of motion from the proximal motion detection circuit.

Figure 12A:
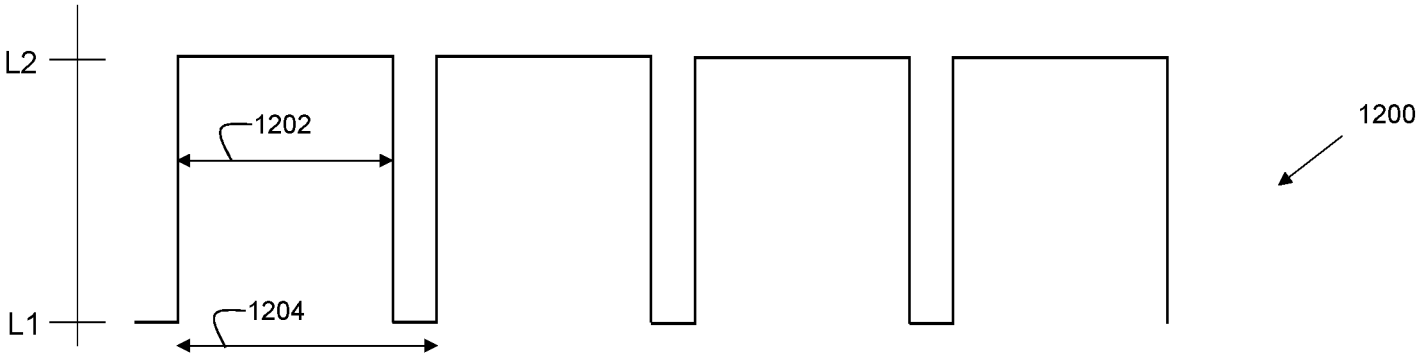
FIG. 12A is an example waveform for normal transceiver mode.

FIG. 12A is an example waveform 1200 used for controlling operation of normal transceiver mode. The level of the waveform 1200 varies between a low level L1, and a high level L2. In embodiments, the low level L1 is zero volts, and the high level L2 is 3.3 volts. Other embodiments may use different voltages for L1 and L2. In some embodiments, a reverse polarity may be used, where L1 is a higher voltage than L2. In embodiments, when the waveform 1200 is in an asserted state, at level L2, the transceivers 112 and/or 114 are enabled. In waveform 1200, the transceivers are enabled for a duration indicated by 1202, and the total cycle is indicated by 1204. Thus, the duty cycle (ratio of asserted portion 1202 to total cycle time 1204) in normal transceiver mode ranges from 0.8 to 0.95 in some embodiments.

Figure 12B:
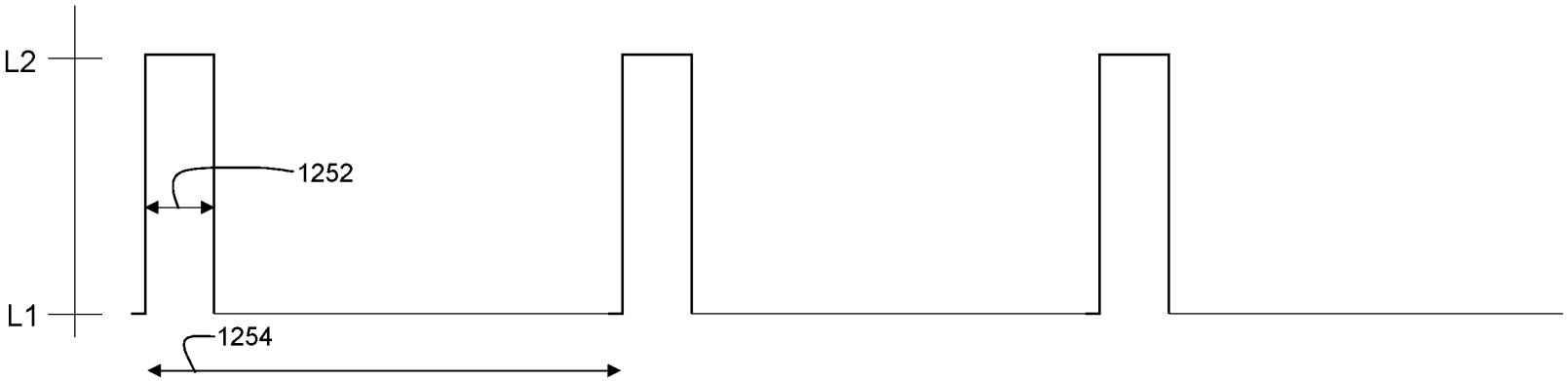
FIG. 12B is an example waveform for reduced transceiver activity mode.

FIG. 12B is an example waveform 1250 used for controlling operation of reduced transceiver activity mode. The level of the waveform 1250 varies between a low level L1, and a high level L2. In embodiments, the low level L1 is zero volts, and the high level L2 is 3.3 volts. Other embodiments may use different voltages for L1 and L2. In some embodiments, a reverse polarity may be used, where L1 is a higher voltage than L2. In embodiments, when the waveform 1250 is in an asserted state, at level L2, the transceivers 112 and/or 114 are enabled. In waveform 1250, the transceivers are enabled for a duration indicated by 1252, and the total cycle is indicated by 1254. Thus, the duty cycle (ratio of asserted portion 1252 to total cycle time 1254) in reduced transceiver activity mode ranges from 0.2 to 0.3 in some embodiments. Thus, in embodiments, the reduced transceiver activity mode includes a transceiver duty cycle ranging from 0.2 to 0.3.

Figure 13A:
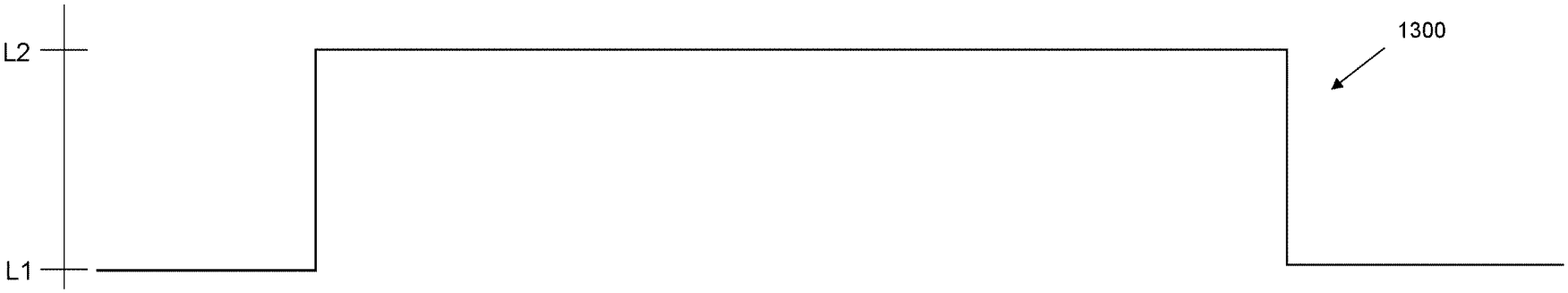
FIG. 13A is an example waveform for normal lock force mode.

FIG. 13A is an example waveform 1300 used for controlling operation of normal lock force mode. The level of the waveform 1300 varies between a low level L1, and a high level L2. In embodiments, the low level L1 is zero volts, and the high level L2 is 3.3 volts. Other embodiments may use different voltages for L1 and L2. In some embodiments, a reverse polarity may be used, where L1 is a higher voltage than L2. In embodiments, when the waveform 1300 is in an asserted state, at level L2, the magnetic lock is activated, and the corresponding entry door is locked. When waveform 1300 is at the deasserted state L1, the door becomes unlocked.

Figure 13B:
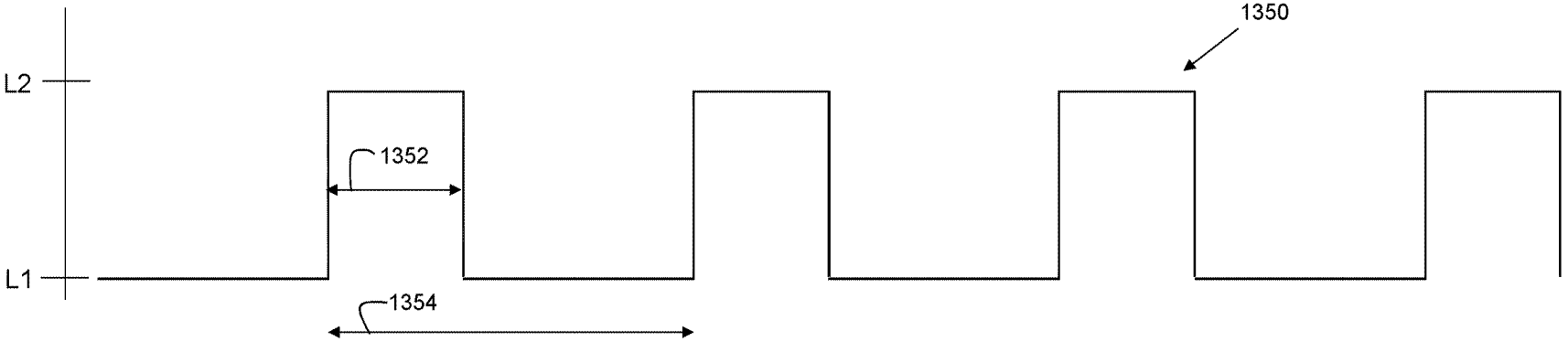
FIG. 13B is an example waveform for lock force reduction mode.

FIG. 13B is an example waveform 1350 used for controlling operation of lock force reduction mode. The level of the waveform 1350 varies between a low level L1, and a high level L2. In embodiments, the low level L1 is zero volts, and the high level L2 is 3.3 volts. Other embodiments may use different voltages for L1 and L2. In some embodiments, a reverse polarity may be used, where L1 is a higher voltage than L2. In embodiments, when the waveform 1350 is in an asserted state, at level L2, the magnetic lock is activated, and the corresponding entry door is locked. When waveform 1300 is at the deasserted state L1, the magnetic lock starts to deactivate. However, it takes a finite time for the magnetic field to collapse and have the door able to be opened. If the waveform 1350 is then asserted again, the magnetic field begins to reform, and the lock force becomes stronger. By performing this pulse width modulation of the waveform 1350, a reduced lock force is achieved. The magnetic lock is still securing its corresponding door, but not with as much force as when using the waveform 1300 of FIG. 13A. In this way, a power savings (and thus, a heat savings) can be achieved, while still providing a level of security for the door. In embodiments, the lock force reduction mode includes pulse width modulation of a power signal supplied to an electrically activated lock. Embodiments can include performing the pulse width modulation of the power signal with a duty cycle of 0.5. In embodiments, the total cycle, indicated by 1354, may range in duration from 400 milliseconds to 700 milliseconds. In a case where the duty cycle is 0.5, the enable duration for each cycle, indicated by 1352, ranges from 200 milliseconds to 350 milliseconds.

The aforementioned waveforms may be used as inputs received by the processor 120 and/or outputs generated by the processor 120 or other circuitry. In embodiments, the waveforms may be used to control the lock interface 140 and/or transceivers of the credential readers 104 and/or 108 in order to implement features of disclosed embodiments.

As can now be appreciated, disclosed embodiments provide a credential reader packaged with an access controller. Embodiments are designed to fit in a single gang box enclosure, enabling convenient installation options. In order to accommodate operation in a confined space, various power management, thermal management, and tamper detections techniques are utilized to provide security and reliability.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. An integrated access system, comprising:

a processor;

a memory coupled to the processor;

one or more credential transceivers;

a power monitoring circuit;

one or more light emitting diodes;

a communication interface;

a proximal motion detection circuit;

a lock interface configured and disposed to operate an electronically activated lock; wherein the memory contains instructions, that when executed by the processor, perform the steps of:

detecting a low power condition from the power monitoring circuit;

sending a low power condition message to a remote computing device; and setting a lock force reduction mode in response to the low power condition; and reverting the lock force reduction mode for a predetermined time interval, in response to detection of motion from the proximal motion detection circuit; and wherein the memory further contains instructions for setting the lock force reduction mode that cause the processor to perform pulse width modulation of a power signal supplied to the electronically activated lock, wherein the total cycle of the power signal has a value ranging from 400 milliseconds to 700 milliseconds.

2. The integrated access system of claim 1, wherein the memory contains instructions, that when executed by the processor, perform the pulse width modulation with a duty cycle of 0.5.

3. The integrated access system of claim 1, wherein the proximal motion detection circuit includes a passive infrared sensor.

4. The integrated access system of claim 1, wherein the memory contains instructions, that when executed by the processor, restores the lock force reduction mode in response to the proximal motion detection circuit detecting a predetermined period of lack of proximity motion.

5. The integrated access system of claim 4, wherein the predetermined period of lack of proximity motion is five seconds.

6. The integrated access system of claim 1, wherein the memory contains instructions, that when executed by the processor, cause the processor to send and receive encrypted messages to the one or more credential transceivers.

7. An integrated access system, comprising:

a processor;

a memory coupled to the processor;

one or more credential transceivers;

a power monitoring circuit;

one or more light emitting diodes;

a backup battery;

a proximal motion detection circuit;

a communication interface;

a lock interface configured and disposed to operate an electronically activated lock; wherein the memory contains instructions, that when executed by the processor, perform the steps of:

detecting a loss of AC power from the power monitoring circuit;

receiving power from the backup battery in response to detecting the loss of AC power;

monitoring backup battery voltage at a predetermined time interval; and setting a lock force reduction mode in response to detecting a decrease in backup battery voltage below a predetermined voltage level, wherein the lock force reduction mode comprises a reduction in power supplied to the electronically activated lock while still maintaining the electronically activated lock in a locked state; and temporarily transitioning from the lock force reduction mode to a normal lock force while operating on battery power in response to detecting motion from the proximal motion detection circuit and wherein the memory further contains instructions for setting the lock force reduction mode that cause the processor to perform pulse width modulation of a power signal supplied to the electronically activated lock, wherein the total cycle of the power signal has a value ranging from 400 milliseconds to 700 milliseconds.

8. The integrated access system of claim 7, wherein the memory further contains instructions, that when executed by the processor, cause the processor to set a reduced transceiver activity mode.

9. The integrated access system of claim 8, wherein the reduced transceiver activity mode includes a transceiver duty cycle ranging from 0.2 to 0.3.

10. The integrated access system of claim 8, wherein the memory further contains instructions, that when executed by the processor, cause the processor to perform the step of reverting the reduced transceiver activity mode for a predetermined duration in response to detecting a proximal access card from the one or more credential transceivers.

11. The integrated access system of claim 7, wherein the memory contains instructions, that when executed by the processor, perform the pulse width modulation with a duty cycle of 0.5.

12. The integrated access system of claim 7, further comprising a proximal motion detection circuit; and wherein the memory contains instructions, that when executed by the processor, perform the step of reverting the lock force reduction mode in response to detection of motion from the proximal motion detection circuit.

13. An integrated access system, comprising:

a processor;

a memory coupled to the processor;

one or more credential transceivers;

one or more light emitting diodes;

a communication interface;

a proximal motion detection circuit;

a lock interface configured and disposed to operate an electronically activated lock; wherein the memory contains instructions, that when executed by the processor, perform the steps of:

establishing communication with the one or more credential transceivers via a cryptographically secured protocol;

in response to detecting a low power condition:

sending a low power condition message to a remote computing device; and setting a lock force reduction mode in response to the low power condition; and reverting the lock force reduction mode for a predetermined time interval, in response to detection of motion from the proximal motion detection circuit and wherein the memory further contains instructions for setting the lock force reduction mode that cause the processor to perform pulse width modulation of a power signal supplied to the electronically activated lock, wherein the total cycle of the power signal has a value ranging from 400 milliseconds to 700 milliseconds.

14. The integrated access system of claim 13, wherein the cryptographically secured protocol includes the Open Supervised Device Protocol.

15. The integrated access system of claim 13, wherein the cryptographically secured protocol includes AES-128 encryption.

16. The integrated access system of claim 13, wherein the cryptographically secured protocol includes Cipher-based Message Authentication Code (CMAC) chaining.

17. The integrated access system of claim 7, wherein the predetermined time interval comprises 300 seconds.

* * * * *